US005473795A

United States Patent [19]

Spix et al.

[11] Patent Number: 5,473,795

[45] Date of Patent: Dec. 12, 1995

[54] FLAT BAR WITH GLIDING PINS FOR CARDING MACHINE TRAVELLING FLATS

[75] Inventors: Guido Spix; Andreas Ebenhöh; Hermann Trützschler, all of Mönchengladbach, Germany

[73] Assignee: Trützschler GmbH & Co. KG, Mönchengladbach

[21] Appl. No.: 54,275

[22] Filed: Apr. 30, 1993

[30] Foreign Application Priority Data

Apr. 30, 1992 [DE] Germany ..... 42 14 200.8
Feb. 12, 1993 [DE] Germany ..... 43 04 148.5

[51] Int. Cl.[6] ..... D01G 15/24

[52] U.S. Cl. ..... 19/113

[58] Field of Search ..... 19/102, 103, 98, 19/104, 113

[56] References Cited

U.S. PATENT DOCUMENTS

| | | | |
|---|---|---|---|
| 3,494,000 | 2/1970 | Smith | 19/102 |
| 4,996,746 | 3/1991 | Verzilli et al. | 39/102 |
| 5,090,092 | 2/1992 | Dempsey | 19/113 |

FOREIGN PATENT DOCUMENTS

| | | | |
|---|---|---|---|
| 009342 | 4/1980 | European Pat. Off. . | |
| 009341 | 4/1980 | European Pat. Off. . | |
| 065848 | 12/1982 | European Pat. Off. . | |
| 384195 | 11/1923 | Germany . | |
| 3907396 | 3/1990 | Germany . | |
| 8915765 | 7/1991 | Germany . | |
| 522686 | 4/1955 | Italy | 19/113 |
| 139824 | 7/1985 | Japan | 19/113 |
| 1493696 | 7/1989 | U.S.S.R. . | |
| 6666 | 4/1892 | United Kingdom | 19/103 |
| 681885 | 10/1952 | United Kingdom . | |
| 870424 | 6/1961 | United Kingdom . | |
| 961646 | 6/1964 | United Kingdom . | |
| 1543334 | 4/1979 | United Kingdom . | |
| 2033936 | 5/1980 | United Kingdom . | |
| 2224043 | 4/1990 | United Kingdom . | |
| 92014873 | 9/1992 | WIPO | 19/113 |

*Primary Examiner*—C. D. Crowder
*Assistant Examiner*—Ismael Izaguirre
*Attorney, Agent, or Firm*—Spencer, Frank & Schneider

[57] ABSTRACT

A flat bar for a travelling flats assembly of a carding machine includes a carrier body having opposite end faces spaced from one another parallel to a longitudinal axis of the carrier body; and a flat bar end adjoining each end face of the carrier body. Each flat bar end includes an element which has a gliding portion having a part arranged for being in a gliding contact with a slideway of the travelling flats assembly; and a securing portion supporting the gliding portion and being attached to the carrier body.

36 Claims, 10 Drawing Sheets

FIG. 5
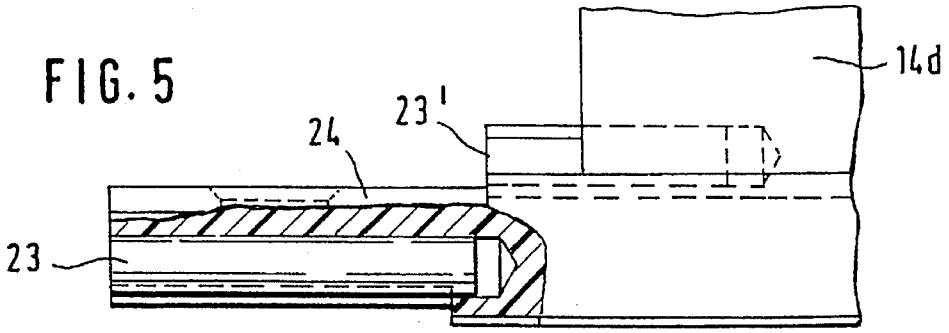
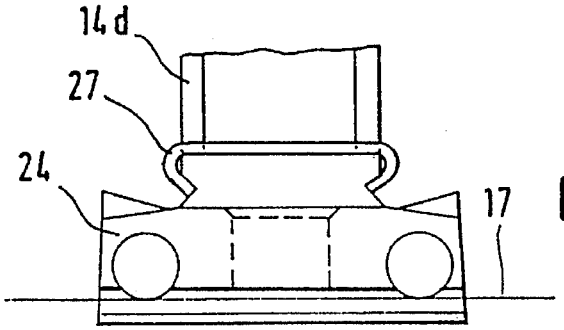
FIG. 6
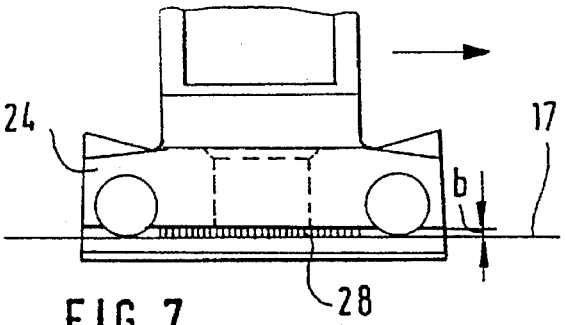
FIG. 7
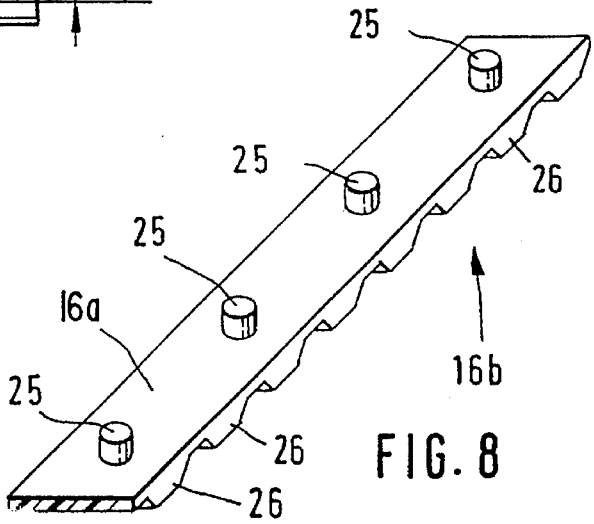
FIG. 8

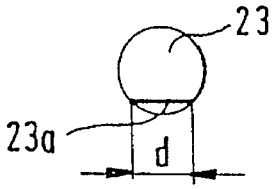
FIG. 9a
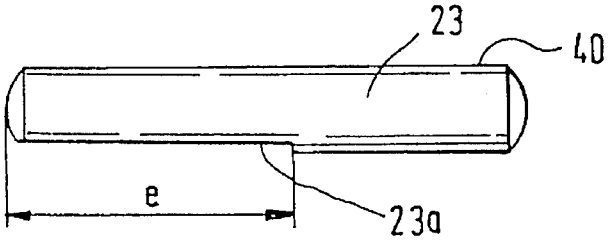
FIG. 9b
FIG. 10
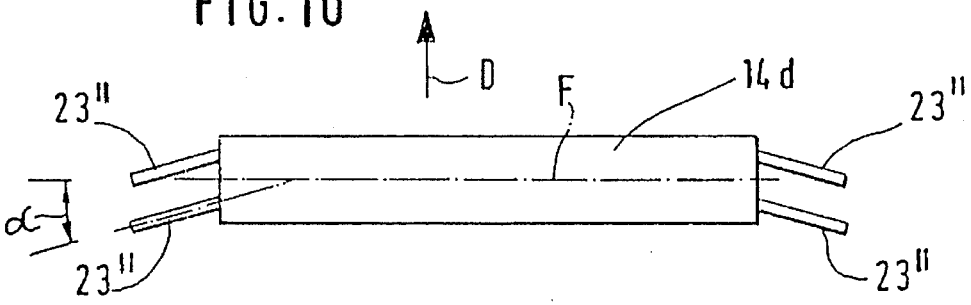
FIG. 11
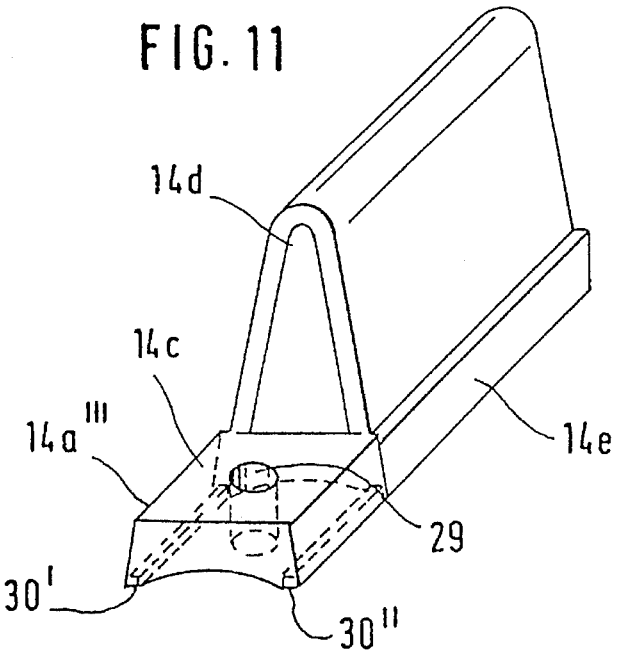

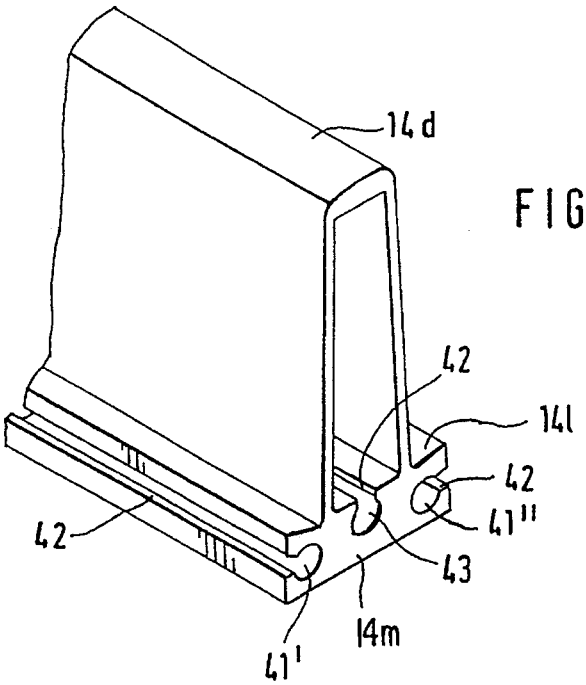
FIG. 12
FIG. 13
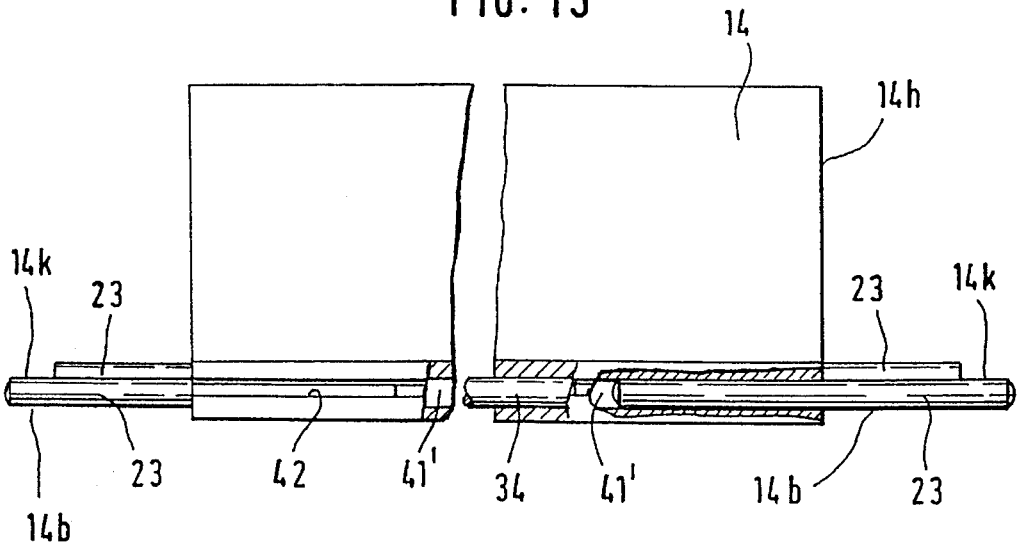

FLAT BAR WITH GLIDING PINS FOR CARDING MACHINE TRAVELLING FLATS

CROSS REFERENCE TO RELATED APPLICATION

This application claims the priority of German Applications No. P 42 14 200.8 filed Apr. 30, 1992 and P 43 04 148.5 filed Feb. 12, 1993, which are incorporated herein by reference.

BACKGROUND OF THE INVENTION

This invention relates to a flat bar for travelling flats in a carding machine. The flat bar has a carrier body with a support for the flat clothing and two opposite flat ends which glide on a slideway and which are force-transmittingly coupled to an endless traction member.

Conventionally, the carrier body of the flat bar is a hollow, extruded aluminum component, and a steel rod extends through the hollow space in the longitudinal direction of the flat bar. On the two opposite, projecting ends of the rod a respective, block-like flat bar ends are inserted and secured by a screw which engages axially a thread provided at the respective ends of the steel rod. The two flat bar ends glide on the stationary slideways of the carding machine. On each side of the flat bar, between the end face of the carrier body and the flat bar end a flat chain (traction member) extends, whose links are traversed by the ends of the flat bar. The flat chain drags the flat bars over the slideways and presses the flat bar ends onto the slideways.

It is a disadvantage of the flat bars according to the prior art that their structure and installation involves substantial expense; particularly the manufacture of the block-like, inserted flat bar ends is complicated. It is a further disadvantage of the conventional flat bar that between the flat bar ends and the slideway significant frictional losses are generated. It is also a drawback that the flat chain stretches, that it is easily soiled with dust and fiber and that the chain links must be lubricated.

SUMMARY OF THE INVENTION

It is an object of the invention to provide an improved flat bar of the above-outlined type from which the discussed disadvantages are eliminated and which thus is structurally simple, it is easy to install and the flat bar ends glide on the slideway of the carding machine with low friction and in an accurate manner.

This object and others to become apparent as the specification progresses, are accomplished by the invention, according to which, briefly stated, each flat bar end has an element which comprises a gliding portion contacting the slideway and a securing portion which is in engagement with the carrier body of the flat bar and which holds the gliding portion.

By virtue of the fact that the element of the flat bar end includes both the gliding portion and the securing portion, a very simple construction of the flat bar ends results. The installation of the flat bar is simplified which facilitates the observation of tolerances and thus enhances dimensional accuracy. Further, the construction according to the invention makes possible a selection of a great number of material pairs which, compared to the prior art constructions, results in a significant reduction of friction and thus to a higher service life of the flat bars.

The invention includes the following additional advantageous features:

The element is a single-piece member.

The element directly engages the carrier body of the flat bar.

The element is in engagement with the carrier body by means of an auxiliary carrier in the zone of the end face of the flat bar.

The element is permanently (non-releasably) connected with the auxiliary carrier.

Each flat bar end has two elements. It is an advantage of this feature that the tendency to tilting and a sliding friction are reduced.

The contacting face of the gliding portion of the element is substantially linear.

The securing portion of the element is of cylindrical configuration. It is an advantage of this feature that an adaptation is feasible to the curved guides (that cause the flat bars to travel in a circular path) without the need for a chamfer or the like. Commercially available hardened and ground steel pins may be economically used for the manufacture of the element of the flat bar end. By cutting to size, drilling and inserting the pins, a particularly simple manufacture of the flat bar is possible.

The securing portion of the element is of polygonal shape.

The gliding portion of the element is of a friction-resistant material.

The elements are secured in the end face of the foot portion of the hollow extruded flat bar body.

The elements are made of pins of tempered (hardened) steel or the like.

The gliding surface of the gliding portion of the element is ground, fine-ground and/or polished.

The securing portion of the element is secured in a recess of the carrier body of the flat bar.

The securing portion of the element is secured in a bore provided in the end face of the carrier body of the flat bar.

The lower boundary of the element is situated at a clearance above the foot surface of the carrier body.

Each element is arranged at an inclination in the working direction to the longitudinal axis of the carrier body of the flat bar such that the gliding portion of the element is oriented opposite the working direction relative to the securing portion.

The carrier body is an extruded member made of a light metal such as aluminum or a light metal alloy. By using a specific light material such as aluminum for the carrier body the force required for moving the flat bars of the travelling flats is reduced. It has been found in practice that it is particularly easy to move the travelling flats with the flexible traction belt by virtue of the lightweight flat bar material and the low-friction, smooth gliding face of the gliding portion of the flat bar elements. The carrier body may be made in a simple manner by cutting commercially available extruded, shaped, hollow rods to the desired lengths. Aluminum provides for a lightweight flat bar and, by making the flat bar as a hollow member, the bending resistance of the carrier body and thus the bending resistance of the entire flat bar is increased as viewed along the card width. Furthermore, by providing a hollow carrier body, material is saved so that the carrier body may be made in a more economical and simpler manner.

In the foot portion of the extruded carrier body throughgoing, parallel recesses (holes) are provided in the longitudinal direction of the flat bar. A throughgoing slot is provided in the wall forming the throughgoing recess.

The throughgoing recesses are cross-sectionally circular.

A stiffening member is arranged in the recesses between the elements of the flat bar.

The cross-sectional outline of the throughgoing recess is polygonal.

The stiffening member is a shaped steel component.

The endless traction member for driving the flat bars is a flexible belt and the outer side of the flexible belt and the portions of the flat bar ends which do not contact the slideway engage the belt in a form-fitting manner.

The gliding portion of the flat bar element has low friction, wear-resistant and precisely dimensioned sliding faces. The use of a flexible belt—in contrast to a flat chain—makes possible that the traction member will not change in length, and further, the flexible belt needs no servicing, it is structurally simple and permits a simple installation of the travelling flats.

A coupling member is provided which is in engagement with the elements of the flat bar ends and with the flexible belt.

One end of the coupling member is secured in or on the end face of the carrier body of the flat bar.

The free end face of the element is at a clearance from the coupling member.

The coupling element is, by means of whiskers, a brush or an elastic wiping element, in a cleaning engagement with the slideway of the travelling flats.

The upper zone of the foot portion of the flat bar body is arranged at an acute angle to the vertical.

The free upper zone of the element is engaged by a support element during the return travel of the flat bar.

The carrier body and the flat bar ends constitute at least three interconnected structural components.

The flexible belt is in a direct engagement with the wear-resistant flat bar ends.

The element is secured in or on the flat bar end.

The gliding portion of the element has a wet-resistant coating.

The element is directly in engagement with the flexible belt.

The coupling member has a projection which is in engagement with the recess.

The coupling member has a throughgoing bore into which engages a projection of the toothed belt.

The coupling member is affixed (clamped or glued) to the flat bar element.

The element is connected to the flat bar body by being press-fitted into the recess.

The element is received in the recess by a resilient clamping means.

The flat bar ends are cast components, particularly die-cast components. The flat bar ends are grey cast iron and the precision foot components may be cast steel. In the alternative, it is feasible to use an element sprayed with a synthetic material, wherein the securing portion as well as the gliding portion of the element is of metal. It is a common characteristic of all the possibilities that the finished flat bar end has the shape of a plug which may be simply inserted into the corresponding recess at the end face of the carrier body of the flat bar.

In an advantageous manufacturing process of the flat bar, the carrier body of the flat bar is cut from an extruded profiled member and the elements are constituted by pins inserted into the flat bar recess.

BRIEF DESCRIPTION OF THE DRAWINGS

FIG. 5 is a fragmentary partially sectional front elevational view of a flat bar including three steel pins.

FIG. 6 is a fragmentary side elevational view of a flat bar including a steel clamp.

FIG. 7 is a fragmentary side elevational view of a flat bar showing a coupling component with whiskers which engage the slideway of the travelling flats.

FIG. 8 is a perspective fragmentary view of a toothed belt having cylindrical projections for engagement with a coupling member of the flat bars and having tooth-shaped projections for engagement with belt-supporting and driving sprockets.

FIG. 9*a* is a side elevational view of an element (pin) of the flat bar according to the invention.

FIG. 9*b* is a front elevational view of the pin shown in FIG. 9*a*.

FIG. 10 is a top plan view of a flat bar, showing the flat bar elements at an oblique angle to the length dimension of the flat bar.

FIG. 11 is a perspective view of a one-piece flat bar whose ends are provided with a wear-resistant coating.

FIG. 12 is a fragmentary perspective view of a flat bar in the end zone of the carrier body.

FIG. 13 is a fragmentary, partially sectional front elevational view of a flat bar.

DESCRIPTION OF THE PREFERRED EMBODIMENTS

Figure 1:
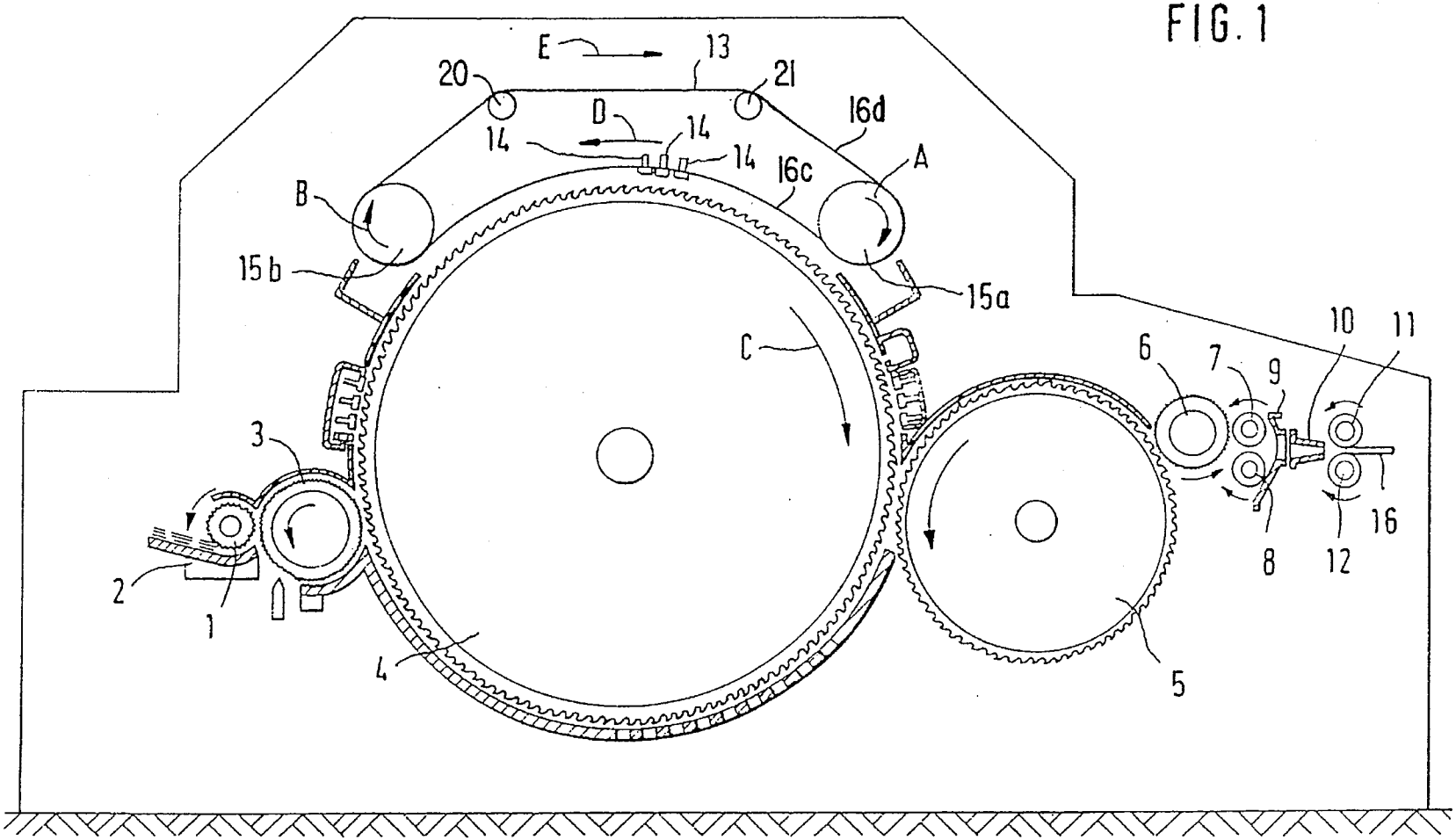
FIG. 1 is a schematic sectional side elevational view of a travelling flats-type carding machine, incorporating the flat bars structured according to the invention.

Turning to FIG. 1, the schematically illustrated carding machine which may be, for example, an EXACTACARD DK 760 model manufactured by Trützschler GmbH & Co. KG, Mönchengladbach, Germany, has a feed roll 1, a feed table 2, a licker-in 3, a main carding cylinder 4, a doffer 5, a stripping roll 6, crushing rolls 7 and 8, a web guiding element 9, a sliver trumpet 10, calender rolls 11 and 12 as well as travelling flats 13. The travelling flats 13 include a frontal and a rear belt supporting sprocket 15*a* and 15*b* respectively. Their direction of rotation, as indicated by the arrows A and B, the same as the direction of rotation of the main carding cylinder 4 as indicated by the arrow C.

Figure 2:
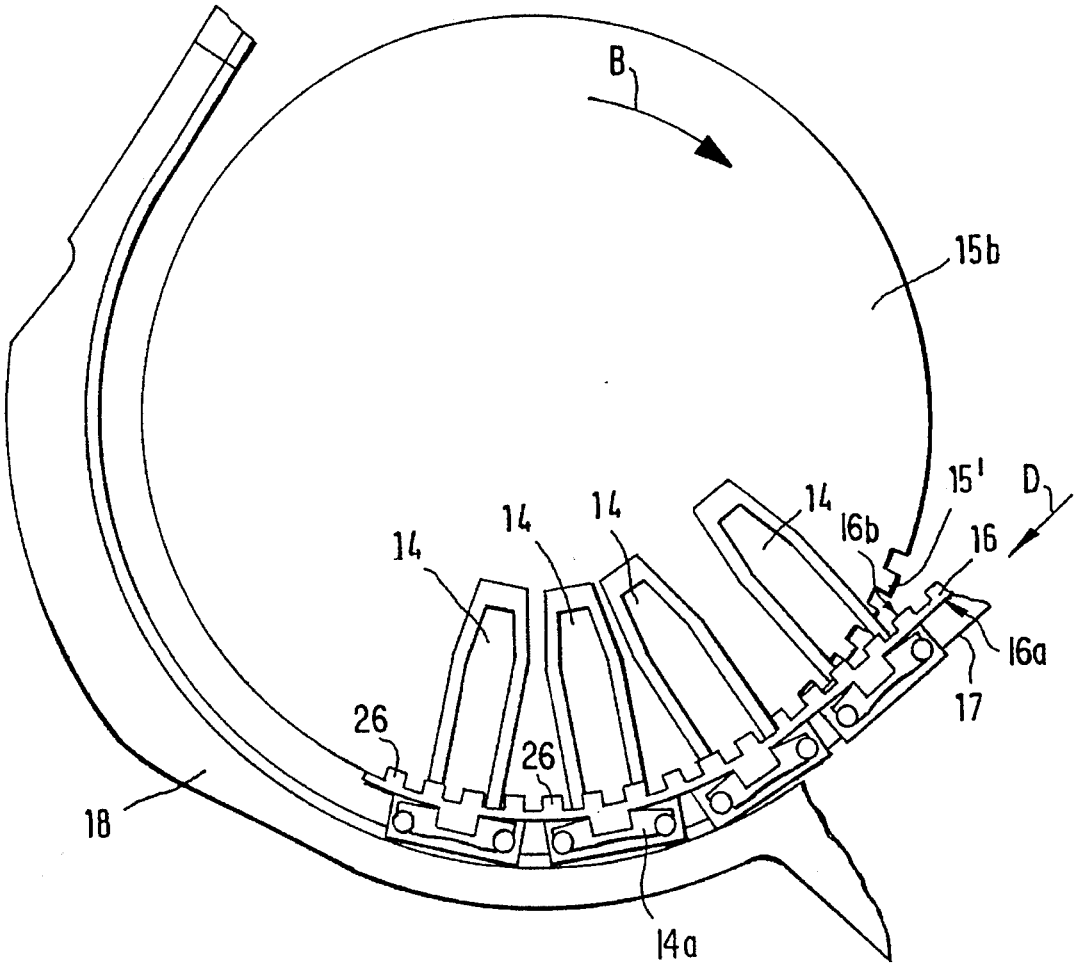
FIG. 2 is a fragmentary schematic sectional side elevational view of the travelling flats shown in the zone of one of the belt supporting end sprockets.
Figure 3:
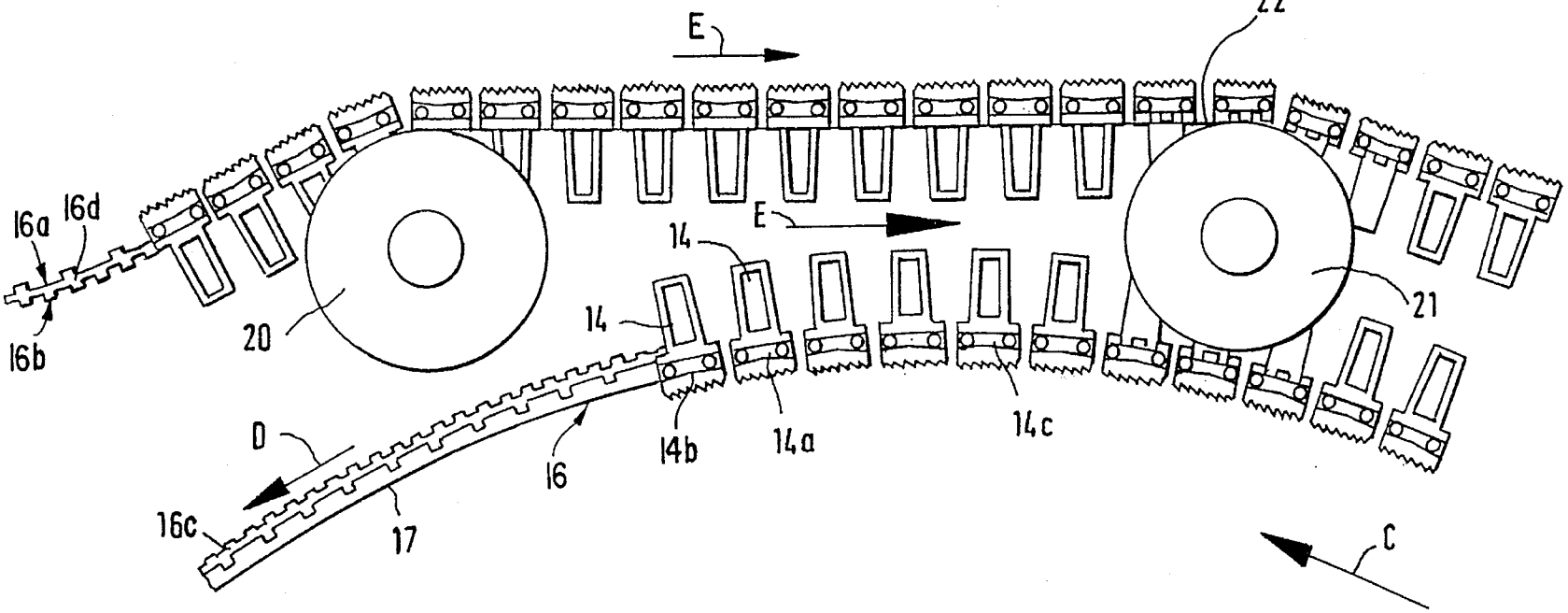
FIG. 3 is a fragmentary sectional side elevational view of a mid zone of the travelling flats.

FIGS. 2 and 3 show the flat bars 14 in further detail, and a flexible endless toothed traction belt 16 which moves the flat bars 14. Each flat bar 14 has opposite flat bar ends 14*a* (only one flat bar end 14*a* is visible in FIGS. 2 and 3) provided with an underside which glides on a respective slideway (flexible bend) 17. The belt sprocket 15*b* which is provided with teeth 15' rotates in the direction of the arrow B and meshes with the teeth 26 provided on the inner side 16*b* of the toothed belt 16. By virtue of this interconnection the lower run 16*c* of the toothed belt 16 is pulled in the forward direction D. The outer side 16*a* of the toothed belt 16 is in a form-locking engagement with that side 14*c* of the flat bar end 14*a* which is opposite the flat bar clothing. The belt 16 presses the flat bar ends 14*a* against the slideway 17. As shown in FIG. 2, a curved guiding and retaining element 18 adjoins and conforms to the curvature of the sprocket 15*b*. The guiding and retaining element 18 holds the flat bars 14 as they travel in a circular path about the sprocket 15*b*. The other sprocket 15*a* (FIG. 1) rotates in the direction of the arrow A and meshes with the teeth 26 on the inner side 16*b* of the belt 16 and pulls the upper run 16*d* of the belt 16 in the direction of the arrow E. The flat bar ends 14*a* of each flat bar 14 lie loosely on the outer side 16*a* of the upper run 16*d* of the belt 16. A non-illustrated curved guiding and retaining element similar to the component 18 is arranged around the sprocket 15*a* for holding the flat bars 14 as they travel along a circular path about the sprocket 15*a*.

As shown in FIGS. 1 and 3, the upper run 16*d* of the toothed belt 16 is supported by two backup rollers 20 and 21 and a planar backup support 22. The support rollers 20 and 21 are belt sprockets which mesh with the teeth 26 provided on the inner side 16*b* of the belt 16.

Figure 4A:
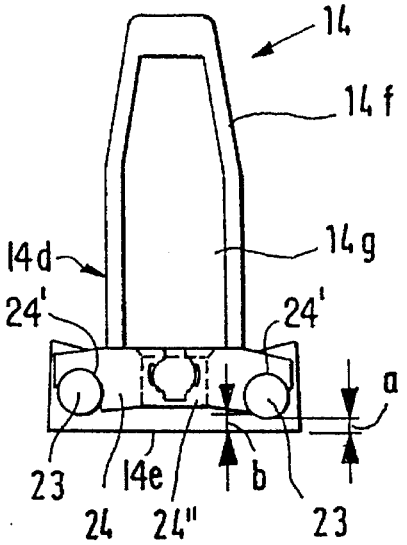
FIG. 4*a* is a side elevational view of a flat bar including a coupling member.
Figure 4B:
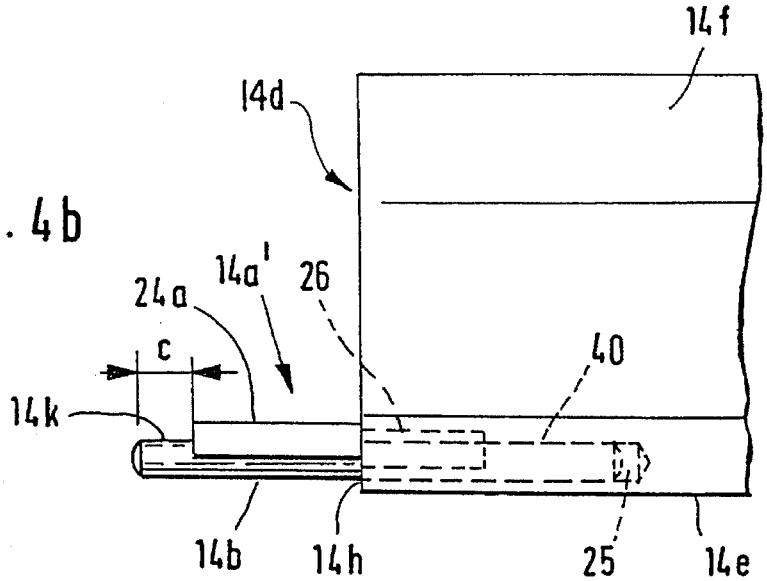
FIG. 4*b* is a front elevational view of a flat bar end of the structure shown in FIG. 4*a*.
Figure 4C:
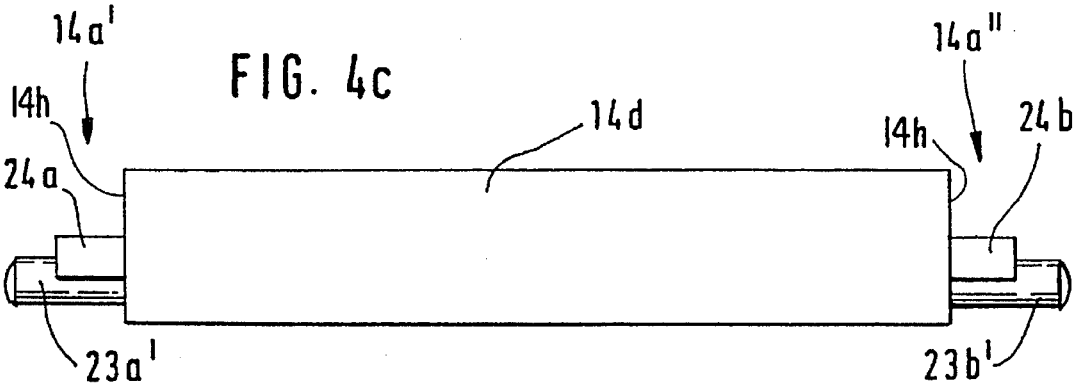
FIG. 4*c* is a top plan view of the entire flat bar of FIG. 4*a*.

Turning to FIGS. 4*a*, 4*b* and 4*c*, the flat bar 14 includes a carrier body 14*d* provided with a clothing support portion 14*e* and a back portion 14*f*. The carrier body 14*d* is an extruded aluminum member having a hollow inner space 14*g*. The flat bar 14 further has two opposite flat bar ends 14*a*' and 14*a*". The flat bar ends 14*a*' and 14*a*" each are formed of two pins 23 and a connecting element 24 (coupling member) which interconnects the pins 23. The pins 23 are, at one end, received in a respective bore 25 provided in the end face 14*h* of the carrier body 14*d*. Viewing FIGS. 3, *a* and 4*b* together, it is seen that the width (that is, the diameter) of any one of the pins 23 measured parallel to the travelling direction E of the flat bars is less than the width of the end face 14*h* of the flat bar, likewise measured in the travelling direction E. The lower boundary of the pins 23 is at a distance a above the foot surface 14*e* of the carrier body 14*d*. The pins 23 which in this embodiment are four in number, are of tempered (hardened) steel and have a circular cross section. The outer surface of the pins 23 is ground, fine-ground or polished to ensure a highly smooth surface. The connecting element 24 has on its lower side two semi-open recesses 24' form-fittingly receiving respective pins 23. The connecting element 24 is made of plastic and is securely clamped, by the recesses 24, on the pins 23. The other (upper) side of the connecting element 24 engages the side 16*a* of the toothed belt 16. The connecting element 24 has in its mid portion a throughgoing bore 24" into which extends a projection 25*a* of the toothed belt 16 (FIG. 8). In this manner the pins 23 are indirectly coupled with the toothed belt 16. The connecting element 24 has at one of its end faces a projection 44 such as a dowel (FIG. 14) which is secured in a bore 26 provided in the end face 14*h* of the carrier body 14*d*. The connecting element 24 is at a clearance b from the foot surface 14*e*. The distance a is less than the distance b.

Between the free end face of each pin 23 and the connecting element 24 a clearance c is provided. The upper, free portions of the pins 23 are in engagement with the planar countersupport 22 (FIG. 3) during the reverse travel of the flat bars 14 in the direction E. The lower portions of the pins 23 glide on the slideways 17 with a linear contacting when they travel during their working pass in the direction D. The slideways 17 may be made of a self-lubricating synthetic material, for example, a high-molecular, low-pressure polyethylene so that a maintenance-free travelling flats track is obtained. It is to be understood that for the slideway 17 another material may be used which has wear-resistant properties and has a long service life, superior sliding properties and low frictional losses. The slideway 17 may be made of metal. The upper face of the slideway 17 is smooth, similarly to the surface of the pins 23.

Thus, according to FIGS. 4*a*, 4*b* and 4*c*, the flat bar 14 is composed of a carrier body 14*d* and two flat bar ends 14*a*' and 14*a*", that is, it is composed of three interengageable structural components. The flat bar ends 14*a*', 14*a*" each is formed of two pins 23 and a connecting member 24, that is, each flat bar end is composed of three individual components.

Turning to FIG. 5, the connecting member 24 extends in its entire length above the pins 23 (only one pin 23 is visible). Above the connecting member 24 there is additionally provided a short pin 23' which is in engagement with the countersupport surface 22 during the reverse (idling) travel of the flat bar in the direction E (FIG. 3).

The construction shown in FIG. 6 essentially corresponds to that shown in FIG. 5. Instead of the pin 23', however a clip 27 made of tempered steel is used for engaging the countersupport surface 22.

According to FIG. 7, the connecting member 24 has at its underside whiskers 28 which engage and clean the slideway 17. The whiskers are, for example, 1 mm longer than the clearance b. The whiskers 28 remove sand, chips and the like from the slideway 17. For cleaning the whiskers 28, at the return side of the travelling flats a cleaning roll (not shown) may be positioned.

Turning to FIG. 8, the toothed belt 16 has on its outer face 16*a* projections 25 made, for example, of rubber. During operation, these projections extend from above into corresponding bores 24" provided in the connecting member 24 (FIG. 4*a*). On the other (outer) belt side 16*b* teeth 26 are provided. The belt 16 may be reinforced with internal, longitudinally extending, tension-resistant flexible steel wires.

FIG. 11 shows a flat bar 14 in which the carrier body 14*d* and the opposite flat bar ends 14*a*'" (only one flat bar end is shown) are formed as a one-piece member, for example, an extruded aluminum component. The upper surface 14c of the flat bar end 14a''' has a throughgoing bore 29 for receiving a projection 25 of the toothed belt 16. On that side of the flat bar ends 14a''' which is oriented towards the foot surface 14e wear-resistant platings 30' and 30" are provided which are in gliding contact with the slideway 17.

The two materials of the gliding face of the flat bar ends and the slideway 17 are so selected that a low friction sliding motion is obtained and further, a lesser wear occurs and the apparatus in operation needs little or no maintenance work.

Turning to FIGS. 9a and 9b, the pin 23 has a rectangular surface 23a having a width d and a length e which may be provided, for example, by grinding. The surface 23a glides on the slideway 17. In this manner, the face-to-face pressure is reduced. Further, the gap between the convex surface of the pin 23 and the slideway 17 is reduced and, as a result, less dirt may accumulate and adhere in those regions.

Turning to FIG. 10, the pins 23" are oriented at an acute angle α to the longitudinal flat bar axis F and are bent in a direction opposite the working direction D. In this manner, dirt is guided by the pins 23" outwardly and in a rearward direction. That part of the pins 23" which is received in the bore 25 may be oriented parallel to the longitudinal axis F of the carrier body 14d; that is, the pins 23" are angularly bent.

FIG. 12 shows an extruded carrier body 14d of a flat bar. The recesses (openings) 41', 41" and 43 which are provided as part of the extrusion process, extend parallel through the entire length of the carrier body 14d. The recesses 41' and 41" serve for receiving the elements (pins) 23. The opening 43 receives the projection 44 (see FIG. 14) provided on the connecting element 24 or the element 23' (FIG. 5). The recesses 41', 42" and 43 are outwardly open by means of longitudinal slots 42 formed in the walls which define the recesses. The side 14l situated opposite the underside 14m of the carrier body 14d is oriented at an acute angle to the underside 14m to facilitate insertion and securement of a non-illustrated flat bar clothing.

FIG. 13 illustrates the pin elements 23 received bilaterally in the recesses 41'. It is seen from FIG. 13 that additionally between the opposite elements 23 a stiffening member 34 is inserted which is at a small distance from the elements 23. The stiffening member 34 provides, on the one hand, that the longitudinal slot 42 cannot deform inwardly and, on the other hand, because of its high specific weight (steel), the stiffening member 34 advantageously effects a downward shift of the center of gravity of the flat bar.

Figure 14:
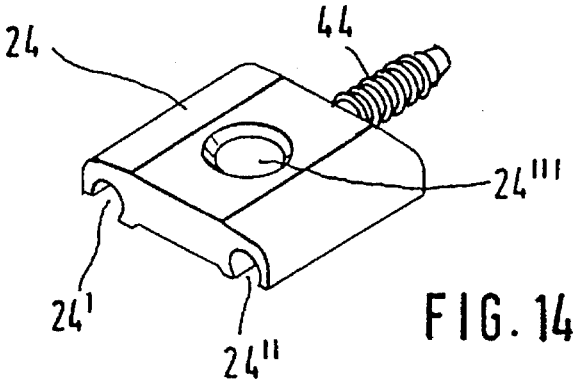
FIG. 14 is a perspective view of a coupling component for a flat bar.

In FIG. 14, the connecting member 24 is shown with a projection 44 which is press-fitted into the recess 43. The guides 24' and 24" clampingly engage the respective pins 23.

Figure 15A:
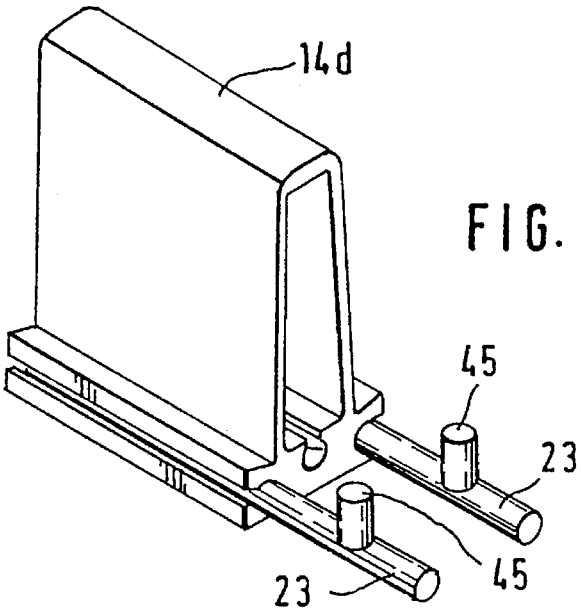
FIG. 15*a* is a perspective view of a flat bar end showing elements with carrier members.
Figure 15B:
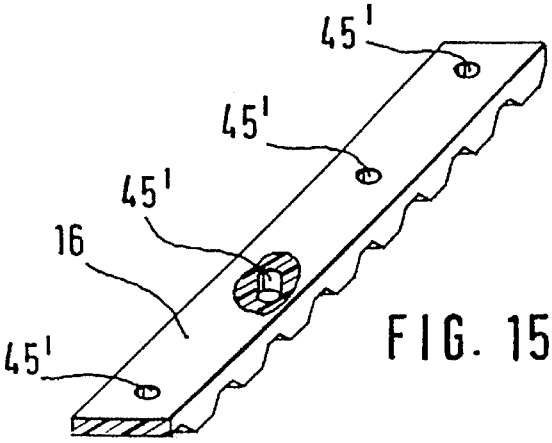
FIG. 15*b* is a fragmentary, partially sectional perspective view of a toothed belt for use with the construction shown in FIG. 15*a*.

In the alternate configuration shown in FIG. 15a, the pins 23 are provided with a carrier member 45 which extends into a recess 45' of the belt 16, as shown in FIG. 15b.

Figure 16A:
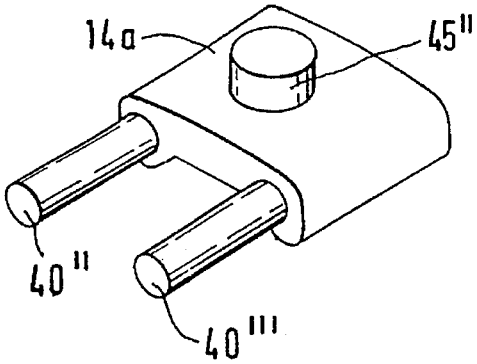
FIG. 16*a* is a perspective view of a plug-in flat bar end according to an embodiment of the invention.

FIG. 16a shows a flat bar end 14a made of a cast piece. The securing portion is formed of two plugs 40" and 40''' which, similarly to the carrier member 45', are integral parts of the flat bar end 14a.

Figure 16B:
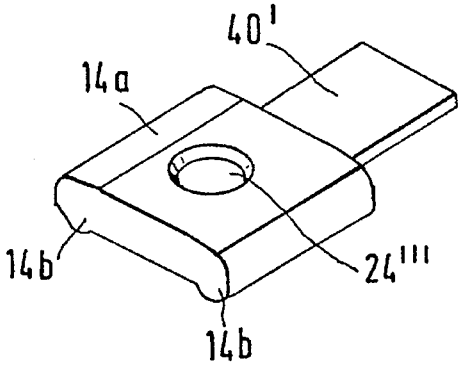
FIG. 16*b* is a perspective view of a plug-in flat bar end according to another embodiment of the invention.

FIG. 16b differs from FIG. 16a in that instead of the carrier member 45" in the flat bar end 14a a bore 24''' is provided which receives a projection 25 of the belt 16. The securing part 40' is plate shaped. The entire construction of the flat bar end is a cast component.

Figure 17A:
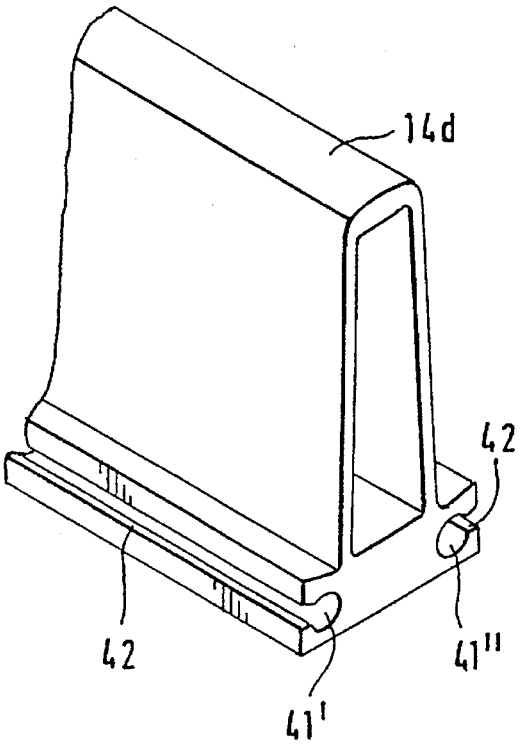
FIG. 17*a* is a fragmentary perspective view of a flat bar end for use with the construction shown in FIG. 16*a*.

FIG. 17a shows the carrier body 14d associated with the flat bar end 14a according to FIG. 16a. The recesses 41' and 41" receive the plugs 40", 40''' of the flat bar end 14a.

Figure 17B:
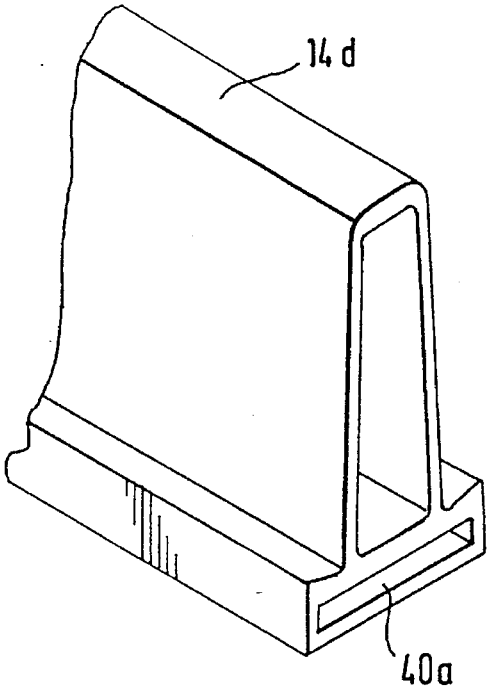
FIG. 17*b* is a fragmentary perspective view of a flat bar end for use with the construction shown in FIG. 16*b*.

FIG. 17b shows a variant of the carrier body 14d for receiving the plate-shaped plug 40' of the flat bar end 14a shown in FIG. 16b. The securing part (plug) 40' is inserted into the recess 40a of the carrier body 14d. The recess 40a of the carrier body 14d extends over the entire length of the carrier body 14d and is provided in the extrusion process.

Figure 18:
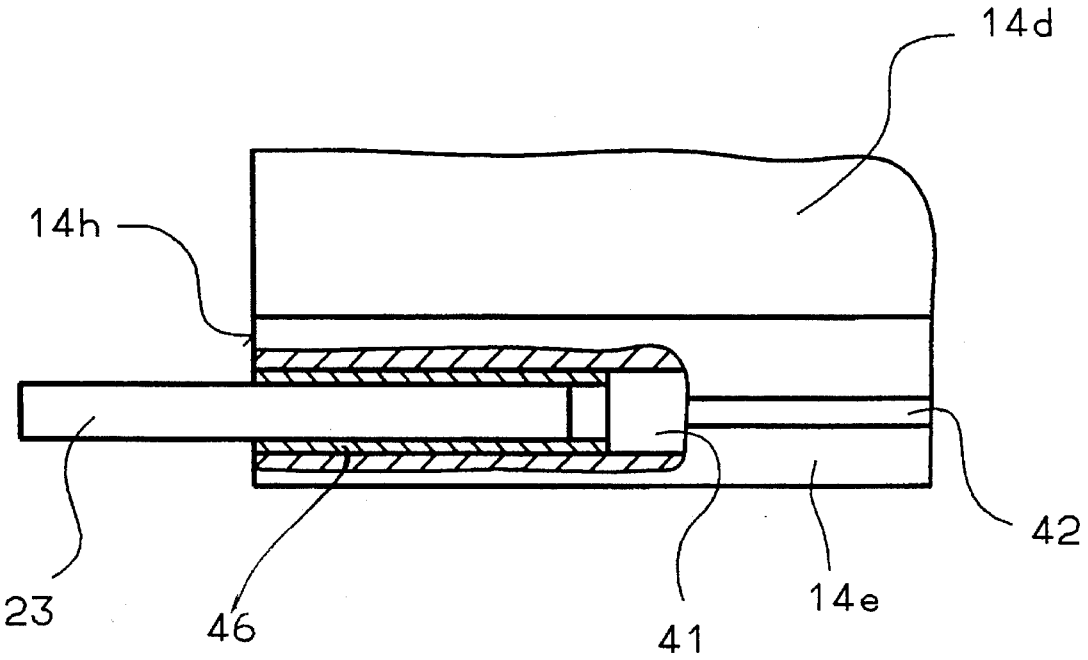
FIG. 18 is a fragmentary, partially sectional front elevational view of another embodiment of a flat bar according to the invention.

Turning to FIG. 18, each pin 23 (only one pin is shown) is held in the respective recess 41 of the carrier body 14d of the flat bar with the intermediary of a sleeve which constitutes an auxiliary carrier. Thus, the pin 23 is fixedly held, for example, by an adhesive in the sleeve whereas the sleeve 46, at its outer surface, is fixedly held, for example, by an adhesive, in the recess 41.

It will be understood that the above description of the present invention is susceptible to various modifications, changes and adaptations, and the same are intended to be comprehended within the meaning and range of equivalents of the appended claims.

What is claimed is:

1. A flat bar for a travelling flats assembly of a carding machine; said flat bar comprising (a) a carrier body having a longitudinal axis and opposite end faces spaced from one another parallel to said longitudinal axis; said carrier body having a travelling direction generally perpendicular to said longitudinal axis and each said end face having a width dimension measured parallel to said travelling direction; and (b) a flat bar end adjoining each said end face of said carrier body; each said flat bar end being composed of at least one elongated pin having a width measured parallel to said travelling direction; said width of said pin being less than said width dimension of said end face; said pin having a securing portion fixedly supported by said carrier body; said pin further having a length portion being adjacent said securing portion and extending outwardly from said end face; said length portion including a gliding surface for slidingly contacting a slideway of the travelling flats assembly.

2. The flat bar as defined in claim 1, wherein said carrier body has a bottom face being at a distance from a bottom face of said pin.

3. The flat bar as defined in claim 1, wherein said securing portion is polygonal.

4. The flat bar as defined in claim 1, wherein said pin is cylindrical and has throughout a circular cross section.

5. The flat bar as defined in claim 1, wherein said pin has a longitudinal axis; further comprising a projection formed on said pin and extending away therefrom transversely to said longitudinal axis of said pin for force-transmittingly engaging an endless traction member of said travelling flats assembly.

6. The flat bar as defined in claim 1, wherein said pin is oriented parallel to said longitudinal axis.

7. The flat bar as defined in claim 1, wherein said carrier body has a foot portion including a bottom face and an upper face spaced from said bottom face; said bottom face being oriented horizontally in an upright position of said flat bar and said upper face being inclined at an acute angle to the vertical.

8. The flat bar as defined in claim 1, further comprising a component attached to said pin at said length portion thereof; said component being arranged for engagement with an endless traction element of the travelling flats assembly.

9. The flat bar as defined in claim 8, wherein said first length portion forms an angle other than 0° or 90° with said longitudinal axis.

10. The flat bar as defined in claim 9, wherein said second length portion is oriented parallel to said longitudinal axis.

11. The flat bar as defined in claim 8, wherein said pin has an outer end and said component is spaced from said outer end in a direction parallel to said longitudinal axis.

12. The flat bar as defined in claim 1, wherein the number of pins extending from each said flat bar end is two.

13. The flat bar as defined in claim 12, further comprising two spaced recesses extending into said carrier body from one of said end faces; said second length portion of said two pins being held in the respective said recesses; said flat bar end further comprising a coupling component extending transversely to said longitudinal axis and connecting the two pins to one another.

14. The flat bar as defined in claim 13, further comprising a clip extending transversely to said longitudinal axis and being secured to said carrier body; said clip having a surface portion adapted to engage a guide component of the travelling flats assembly during an idle or return travel of the flat bar.

15. The flat bar as defined in claim 13, further comprising a depression provided in said coupling component for force-transmittingly engaging an endless traction member of the travelling flats assembly.

16. The flat bar as defined in claim 13, wherein said coupling component has an underside; further comprising whiskers secured to said underside for cleaningly engaging the slideway of the travelling flats assembly during travel of the flat bar.

17. The flat bar as defined in claim 13, wherein said recesses are laterally open in a direction parallel to said longitudinal axis.

18. The flat bar as defined in claim 13, wherein said carrier body, said pins and said coupling components have a bottom face; further wherein said bottom face of said carrier body is at a first distance from said bottom face of said pins and said bottom face of said carrier body is at a second distance from said bottom face of said coupling component; said first distance being shorter than said second distance.

19. The flat bar as defined in claim 13, further comprising an additional recess provided in said carrier body between said two recesses; said coupling component having a projection received in said additional recess.

20. The flat bar as defined in claim 13, wherein each said second pin portion has a length and said coupling component extends over an entire length of said second pin portion.

21. The flat bar as defined in claim 13, further comprising an additional pin extending between and parallel to said two pins and being secured to said carrier body; said additional pin having a surface portion adapted to engage a guide component of the travelling flats assembly during an idle or return travel of the flat bar.

22. The flat bar as defined in claim 13, wherein said coupling component is affixed to said carrier body.

23. The flat bar as defined in claim 13, wherein said coupling component is firmly attached to said pins.

24. The flat bar as defined in claim 1, wherein said pin is of tempered steel.

25. The flat bar as defined in claim 1, wherein said pin is a single-piece component.

26. The flat bar as defined in claim 1, wherein said sliding surface is planar.

27. The flat bar as defined in claim 1, wherein said length portion is a first length portion and said securing portion constitutes a second length portion of said pin; said second length portion being received in and fixedly supported by said carrier body.

28. The flat bar as defined in claim 27, wherein said pin is cylindrical and said gliding surface is flat.

29. The flat bar as defined in claim 27, wherein said second length portion is in direct engagement with said carrier body.

30. The flat bar as defined in claim 27, wherein said carrier body has parallel recesses extending through the entire length of said carrier body; each said recess receiving said second length portion of the pins extending from the flat bar ends.

31. The flat bar as defined in claim 27, wherein said carrier body has a recess extending within a foot portion of said carrier body along the entire length of said carrier body and being open at said opposite end faces; said recess receiving said second length portion of the pins extending from the flat bar ends.

32. The flat bar as defined in claim 31, further comprising a reinforcing part received in said recess between said pins.

33. The flat bar as defined in claim 31, wherein said recess has a polygonal cross-sectional outline.

34. The flat bar as defined in claim 27, wherein said pin is press-fitted into said carrier body.

35. The flat bar as defined in claim 27, further comprising a sleeve received in said carrier body; said second length portion being received in said sleeve.

36. The flat bar as defined in claim 35, wherein said second length portion is permanently affixed to said sleeve.

* * * * *